US005524611A

United States Patent [19]

Fu

[11] Patent Number: 5,524,611

[45] Date of Patent: Jun. 11, 1996

[54] SWIMMING MASK WITH AUTOMATIC DRAINAGE

[76] Inventor: John Y. Fu, 16320 Canelones Dr., Hacienda Heights, Calif. 91745

[21] Appl. No.: 279,407

[22] Filed: Jul. 25, 1994

[51] Int. Cl.[6] ..... B63C 9/00

[52] U.S. Cl. ..... 128/201.11; 128/200.29; 128/201.26; 128/201.28

[58] Field of Search ..... 128/200.24, 200.29, 128/201.11, 201.26, 201.27, 201.28, 207.14, 207.16

[56] References Cited

U.S. PATENT DOCUMENTS

| | | | |
|---|---|---|---|
| 859,786 | 7/1906 | Steenerson | 128/201.11 |
| 1,282,527 | 10/1918 | Bidonde | 128/201.11 |
| 2,317,236 | 4/1943 | Wilen et al. | 128/201.11 |
| 2,317,237 | 4/1943 | Wilen | 128/201.11 |
| 3,166,083 | 1/1965 | Girden | 128/201.11 |
| 3,345,984 | 10/1967 | Katchis | 128/201.11 |
| 4,226,234 | 10/1980 | Gunderson | 128/205.24 |

*Primary Examiner* Edgar S. Burr
*Assistant Examiner* V. Srivastava

[57] ABSTRACT

Here discloses a swimming mask with a mobile cover which is able to close the air valve when the water comes in and open the air valve when water fades away, allowing only air to be exchanged. Within the plastic protective cover, there is an open valve serves only for the drainage of water that comes into the plastic tube from the upper part of the cover, not allowing any water to come into the tube from the base or the cover. This permits a continuous supply of fresh air. As a visual enhancer, the objective of this invention is to help the beginners to be familiarized with water and gain interest in swimming. As for the swimmers, the objective is to reduce the fatigue caused by the duration and the distance of swimming and by the head-neck coordination for the ventilation process. Young toddlers and kids, with the aid of the swimming mask, are able to learn to swim at a faster rate. This mask promotes efficiency, prevents juvenile swimming accidents, and most of all, reduces the fear of water.

1 Claim, 5 Drawing Sheets

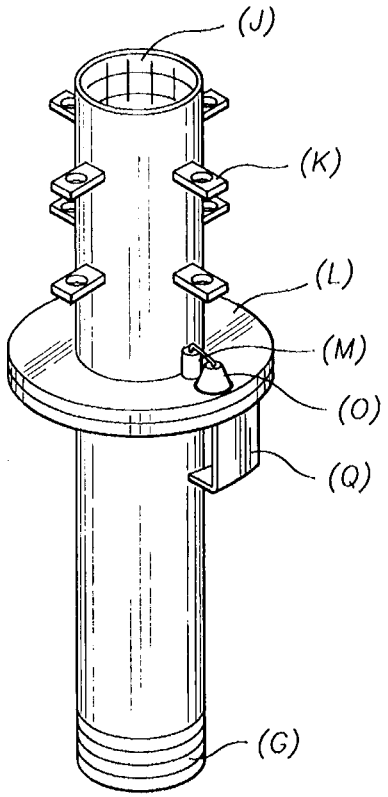
FIG. 3
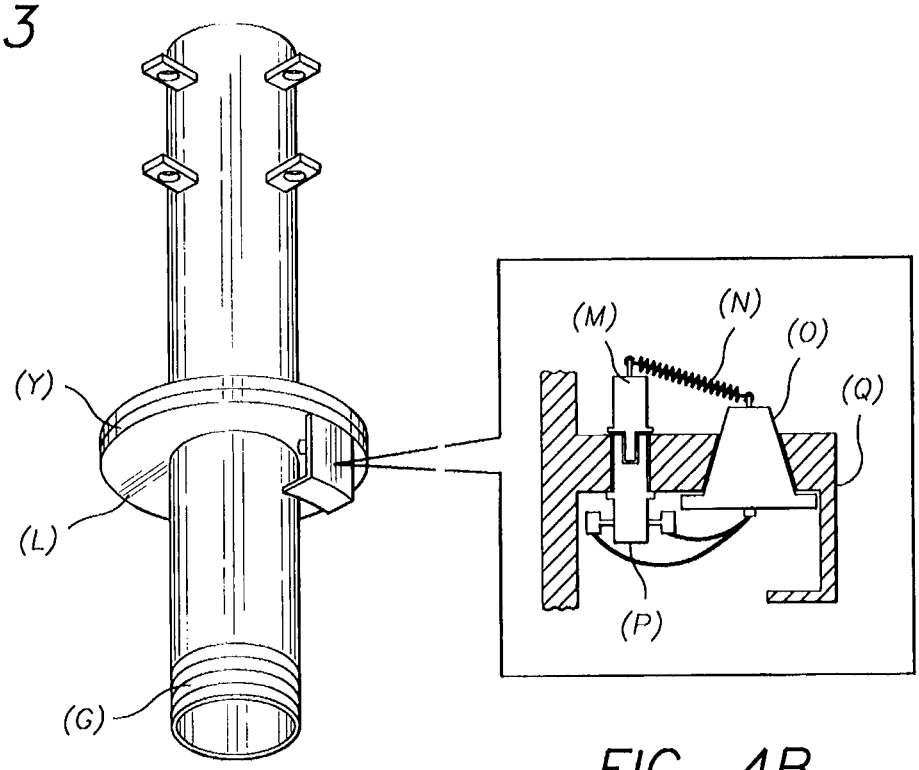
FIG. 4B
FIG. 4A

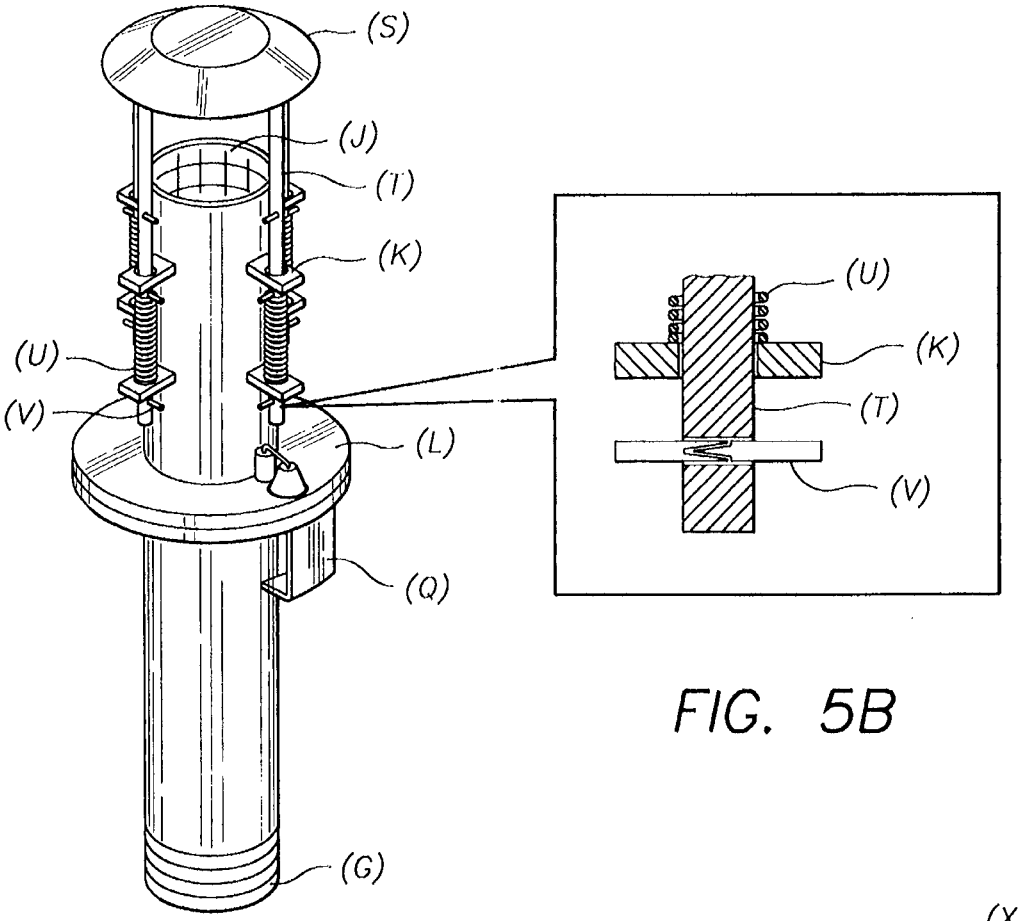
FIG. 5B
FIG. 5A
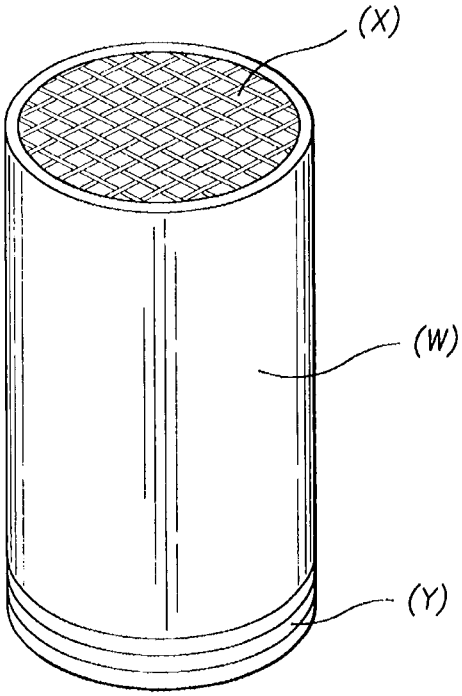
FIG. 6

SWIMMING MASK WITH AUTOMATIC DRAINAGE

CROSS-REFERENCES TO RELATED APPLICATIONS

None.

U.S. PATENT DOCUMENTS

| | | | |
|---|---|---|---|
| (1) 2317237 | 04/1943 | C. H. Wilsen | 128 201.11 |
| (2) 3166083 | 01/1965 | B. B. Girden | 128 201.11 |
| (3) 1282527 | 10/1918 | G. Bidonde | 128 201.11 |
| (4) 859786 | 07/1906 | H. Steenerson | 128 201.11 |
| (5) 3345984 | 10/1967 | G. Katchis | 128 201.11 |
| (6) 2317236 | 04/1943 | C. H. Wilsen et all | 128 201.11 |

BACKGROUND OF THE INVENTION (1) Field of the Invention

This invention pertains to an air valve of a swimming mask which utilizes the mechanism of springs to regulate the opening and closing of the tube for air circulation on the surface of the water. The presence of the springs will prevent the tube from closing permanently to stop the air inflows. The drainage system of this swimming mask employs a flapper which can drain out any water that comes in from the upper end of the tube.

(2) Description of the Related Art

Representative of the related art known is the U.S. Pat. No. 2,317,236 to C. H. Wilsen et al in which the air intake and outlet valve is a ball valve which is to open or close the flange to prevent water from entering the tube under the surface of the water. In this drainage system, water which may enter the tube will pass through the face to the bottom valve and eventually be purged out through the bottom valve by either submerging the head underneath the water or blowing into the mouthpiece while pressing against the ball valve by hand.

The applicant's swimming mask is imagined according to the human respiratory system around the throat. The biological principle of separating water and air at the pharynx into esophagus and trachea is applied to the design of the protective cover and the air intake and outlet valve on the top part of the plastic tube that is connected with the mask. During swimming, the valve utilizes the springs to open or close the mobile cover depending on the absense or the presence of an external water pressure from the top of the protective cover. This valve will discriminately allow only air to enter into the mask through the plastic tube, thus giving the user a bountiful supply of air. If water enters into the protective cover accidentally, it will be drained out automatically through a hole at the base of the protective cover, preventing it from entering the plastic tube.

SUMMARY

The air intake and outlet valve on top of the protective cover of the applicant's swimming mask is designed to have its opening facing upward. The drainage valve is located at the base of the protective cover. Therefore any external water which enters into the air intake and outlet valve will be purged through the drainage valve. If water of a sizable wave hits onto the top of the protective cover exerting pressure on the mobile cover of the valve, the mobile cover supported by the legs that is supported by sensitive springs will close the air valve, not allowing any water to enter into the plastic tube. This is the same principle in biology that water has few chances to enter into the trachea from the pharynx. Unlike the U.S. Pat. No. 2,317,236 to C. H. Wilsen et al or U.S. Pat. No. 859,786 to H. Steenerson which has a mask having the opening of the air tube facing downward permitting an easy entrance for the surface water into the air valve to pass through the face and then to be purged, this design will inhibit any entrance of water into the mask, allowing a more comfortable sensation for the user.

The main objective of the applicant's swimming mask is to provide a continuous supply of air for a swimmer. This will reduce the need for the head-neck coordination of the ventilation process which results in fatigueness.

This invention is chiefly composed of plastic and rubber materials. This will lessen any stress on the head and the neck from wearing the mask during swimming.

BRIEF DESCRIPTION OF THE DRAWING

FIG. 3 is a general view showing the overall structure of the plastic air tube.

FIG. 4A is a view of the base of the plastic tubing.

FIG. 4B is a fragmentary sectional view showing the details of the drainage system and its flapper in function.

FIG. 5A is a detailed sketch of the plastic tubing with the mobile cover and the springs.

FIG. 5B is a fragmentary sectional view describing the pegs fastened on the legs of mobile cover.

FIG. 6 is the protective cover of the plastic tubing.

DESCRIPTION OF THE PREFERRED EMBODIMENTS

Figure 1:
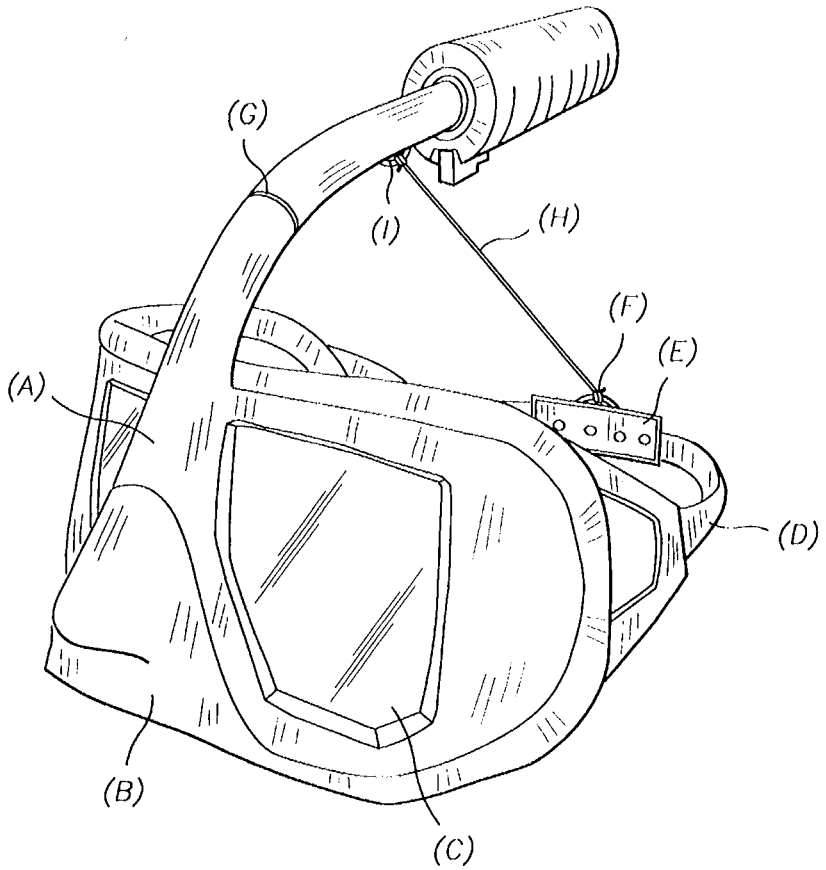
FIG. 1 is the profile of the swimming mask.
Figure 2:
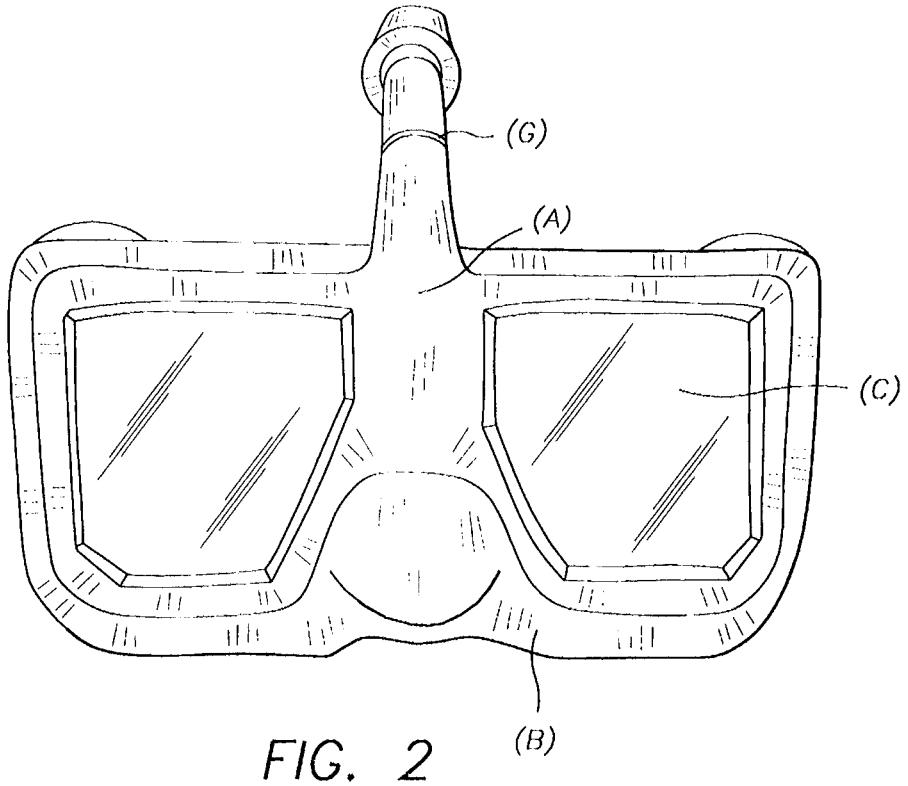
FIG. 2 is the face view of the mask.
Figure 7:
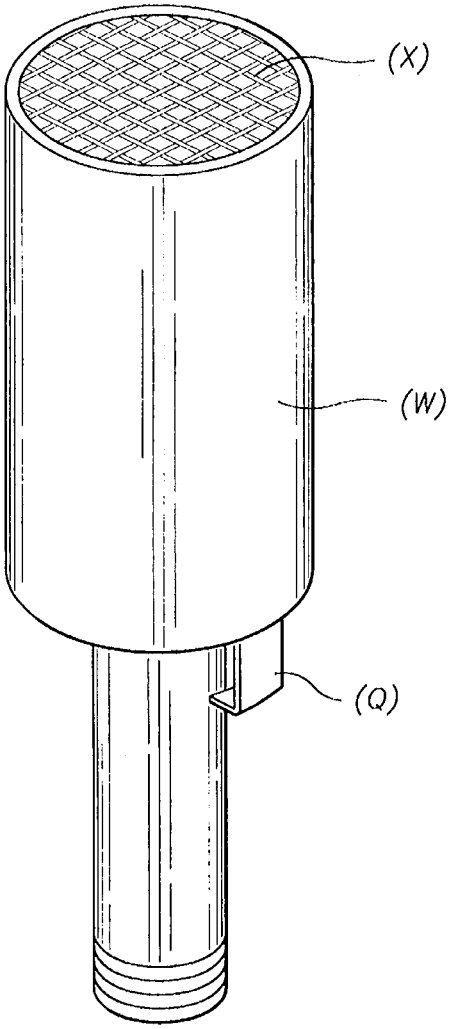
FIG. 7 is a view of the plastic tubing with its protective cover.
Figure 8:
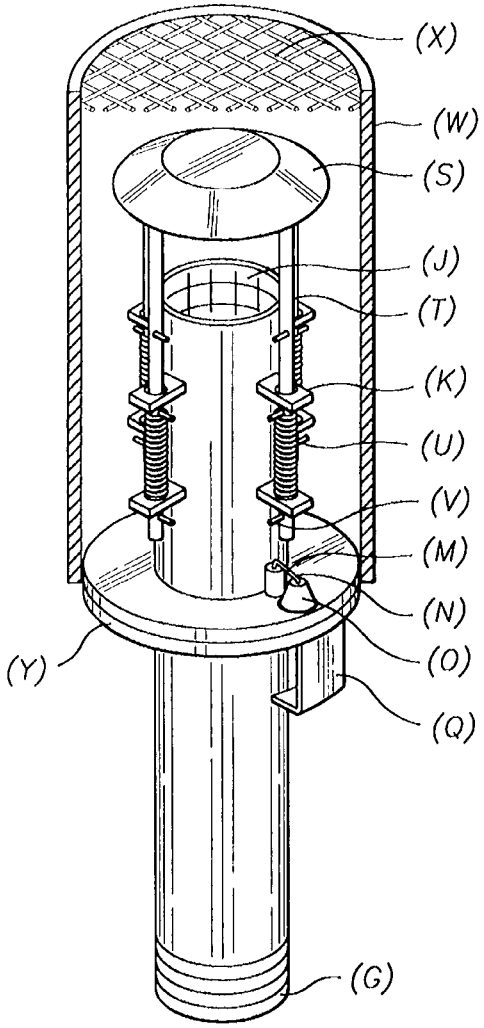
FIG. 8 is the sectional axonometric of the plastic tubing and the protective cover.
Figure 9:
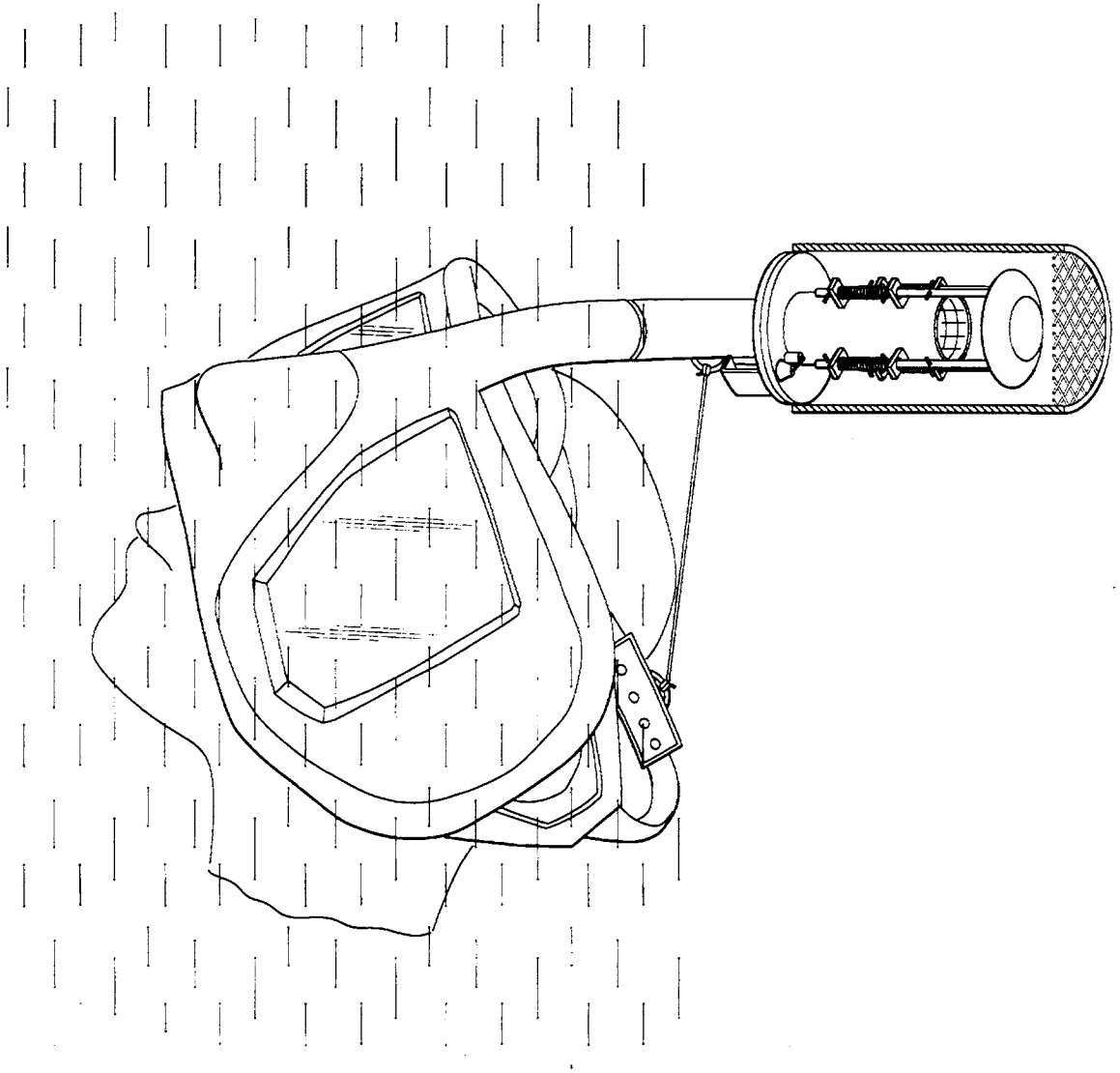
FIG. 9 is a broken view showing the structure of the invention in an operating position.

The swimming mask can be divided into four parts and twenty-five elements as indicated by capital letter in order to describe the mode of the mask.

(1) The mask mainly consists of a pair of transparent hard plastic lenses (C) encircled by soft rubber (B) which fits comfortably on the face of the swimmer. The plastic tube extends from the nose to the top of the head. The nostril part of the plastic tube of the mask is in the shape of a human nose; its size is assumed to be larger than normal. The plastic tube thus elongates from the nostril part and gradually tapers into a form of a tube. It has a curvature according to the shape of a human forehead while stretching out to the top of the head. At the top end of this tube, there are grooves(G) for screwing on to another plastic tube consisting of the protective cover, air and drainage valves. This invention is intended to cover only the upper part of the face until the upper lip.

(2) Plastic Tubing: Using the grooves (G) at the ends to connect the two sections of the tube, the tube stretches from the nose and curves along the forehead to the top of the head, perpendicular to the back of the head. It extends straight up into the air if the swimmer submerge his head under water. The plastic tubing can be divided into three parts for a detailed description of its structure.

i) Ventilation Parts: The upper end of the tubing has an opening (J) for the circulation of air. Along the outer surface of the tube after the opening, there are four (more or less) pairs of stabilizing plates (K). Each pair are separated by a distance that is the length of the springs used. These stabilizing plates have holes in the center for the legs (T) of the mobile mushroom-shape cover (S) to fit through. This mobile mushroom cover assumes a cylindrical shape with a dome-like structure at the top. Its diameter is designed to be slightly larger than the diameter of the plastic tubing for the regulation of the opening and the closing of the air valve.

There are four (more or less) sets of pegs (V) to fastened the legs of the mushroom cover to the stabilizing plastes through the holes on the legs. In between each pair of the stabilizing plates, there is a sensitive spring with one leg of the mushroom-shape cover insetted. This will permit the mobility of the mushroom-shape cover to be closed when it encounters water and to resume its original position after.

ii) The Circular Base (L): Its perimeter has grooves(Y) designed for attachment with the protective cover (W). This is to hinder the surface water from entering into the tube. At the base, there is another opening for the drainage system and its flapper.

iii) Flapper Device: This valve (R) for drainage is always open to purge out any water coming in from the upper end of the tubing. In contrast with the Toilet Tank's Bull Eye Flapper System, this flapper (O) is reversed in direction, allowing only water to drain out from the tubing. When water splashes against the bottom of the base (L), the flapper will close the drainage valve to prevent any entrance of water into the tubing. This flapper device is stabilized by a trident-like screw, with a pole (P) extending out, linking the flapper with a stainless chain (N) which controls the opening and closing of the flapper. There is a shield-like structure (Q) designed to protect the flapper from any hard or sharp objects in water. This flapper device can be likened to the air intake and outlet ball valve of the U.S. Pat. No. 2,317,236 to C. H. Wilsen et al. The ball valve can substitute for the flapper, in that it is also able to close the opening when water splashes against it to prevent any entrance of water.

(3) The protective cover (W) has a form of a cylindrical shape whose diameter corresponds to the diameter of the base (L). It should be made from plastic materials which are strong enough to withstand any water pressure. The upper part of the cover is a net-like design which allows for the circulation of air in and out of the tube. The lower part of the cover also has grooves to be screwed on to the base (L) of the plastic tubing.

(4) The mask has an adjustable strap (D) using buttons (E) for a comfortable wear. Furthermore, there are two links, one link (I) on the tube and the other link (F) on the adjustable strap. These are to anchor the plastic tubing to the strap by means of a nylon thread (H). This invention is to be worn first from the top of the head, then slowly pulling it down until the upper lip.

I claim:

1. A swimming mask for covering the nose and eyes including lenses for the eyes, said mask having soft rubber around its edges and around the edges of the lenses to prevent water from entering the mask or steaming the lenses, said swimming mask having an air intake comprising;

a flange around said air intake, a cylindrical protective cover having a net-like top which allows circulation of air through said net-like top, and a drainage valve for draining splashed water, said cylindrical protective cover being screwed on to said flange;

stabilizing plates attached to said air intake, each of said stabilizing plates having a hole therein; and a mushroom-shaped cover movably attached to the air intake, a plurality of legs attached to and supporting said mushroom-shaped cover for movement between an open position and a closed position, each of said legs having two holes therein and passing through two of said stabilizing plates, springs encasing said legs between said stabilizing plates, pegs positioned in said holes in said legs to limit the movement of said legs through said stabilizing plates, whereby water passing through said net-like top causes said mushroom-shaped cover to regulate air circulation in said air intake and drains through said drainage valve.

* * * * *